United States Patent [19]

Allen

[11] 4,246,977

[45] Jan. 27, 1981

[54] DIAMOND STUDDED INSERT DRAG BIT WITH STRATEGICALLY LOCATED HYDRAULIC PASSAGES FOR MUD MOTORS

[75] Inventor: James H. Allen, Lakewood, Calif.

[73] Assignee: Smith International, Inc., Newport Beach, Calif.

[21] Appl. No.: 28,629

[22] Filed: Apr. 9, 1979

[51] Int. Cl.[3] ..... E21B 9/02; E21B 9/36

[52] U.S. Cl. ..... 175/329; 175/393; 175/410

[58] Field of Search ..... 175/329, 339, 418, 400, 175/410, 413, 65

[56] References Cited

U.S. PATENT DOCUMENTS

| | | | |
|---|---|---|---|
| 1,388,490 | 8/1921 | Suman | 175/391 |
| 1,945,160 | 1/1934 | Pearce | 175/393 |
| 2,119,349 | 5/1938 | Pearce | 175/393 |
| 2,371,489 | 3/1945 | Williams, Jr. | 175/329 |
| 2,966,949 | 1/1961 | Wepsala, Jr. | 175/329 |
| 3,106,973 | 10/1963 | Christensen | 175/410 |
| 3,269,470 | 8/1966 | Kelly, Jr. | 175/410 |
| 3,871,488 | 3/1975 | Sabre | 175/410 |
| 4,073,354 | 2/1978 | Rowley et al. | 175/410 |
| 4,098,363 | 7/1978 | Rohde et al. | 175/329 |

*Primary Examiner*—James A. Leppink
*Attorney, Agent, or Firm*—Robert G. Upton

[57] ABSTRACT

A diamond studded insert drag bit is disclosed having a multiplicity of individual diamond insert cutter blanks inserted in the face of the bit. The diamond insert blanks are so positioned to maximize penetration of the bit in a borehole. The bit further includes fluid passages strategically located in the bit face to provide uniform flow, cooling and continuous cleaning of each of the diamond cutter insert blanks. The fluid passages are so sized to cause minimum bit pressure drop. Bits with minimum pressure losses from fluid flow are best suited for positive displacement mud motors that cannot tolerate downstream pressures in excess of 50 to 500 pounds per square inch.

1 Claim, 4 Drawing Figures

DIAMOND STUDDED INSERT DRAG BIT WITH STRATEGICALLY LOCATED HYDRAULIC PASSAGES FOR MUD MOTORS

BACKGROUND OF THE INVENTION

1. Field of the Invention

This invention relates to diamond studded insert drag bits.

More particularly, this invention relates to drag bits with a multiplicity of individual diamond faced tungsten carbide inserts mounted in the face of the drag bit with strategically located fluid coolant passages adjacent the inserts to constantly cool and clean each insert blank.

2. Description of the Prior Art

Most state of the art diamond drag bits are designed with the first consideration given to location of the individual diamond cutter inserts.

For example, U.S. Pat. No. 4,098,363 discloses a diamond drill bit employing spaced, shaped diamond cutter elements arranged in rows separated by large fluid channels. The channels are formed in the bit body and are utilized for bit cleaning and detritus removal action. A series of nozzles are randomly placed within the channels, the channels themselves distribute the fluid over the array of diamond cutters. This type of bit is normally fabricated from a material which is highly resistant to erosion, especially where fluid channels are provided in the face of the bit. The diamond drill bit just described is cast from expensive carbide material with the waterway channels formed therein to provide an erosion resistant base for the bit body.

This patent is disadvantaged in that fluid flowing in the channels positioned nearest the center of the bit flows at a higher velocity than the fluid flowing through channels positioned radilly outwardly from the center resulting in a non-uniform flow velocity condition. Also the fluid volume passing individual cutters or pairs of cutters is not uniform.

The diamond studded insert drag bit of the present invention is relatively flat-faced with multiple fluid channels formed in the face of the bit. The diamond insert blanks are so positioned to most effectively advance the bit in the borehole. The fluid passages are strategically located adjacent the inserts to provide uniform flow and a relatively even pressure drop over the entire face of the bit as well as cool and clean the individual inserts. No special materials or coolant passage channels are necessary to achieve these parameters.

The fluid passages are simple openings or holes to admit fluid through the bit as opposed to nozzle bodies that serve to accelerate the fluid out of the nozzle. Since the fluid flow is more constant because of the strategic hole locations, a more uniform velocity distribution across the face of the bit results. Since fluid flow is constant and exit velocities are lower, bit erosion is minimal. Therefore, the bit body need not be cast from expensive carbide material and complicated channel waterways are unnecessary. The instant invention teaches the fabrication of diamond studded insert drag bits from machined alloy steel.

SUMMARY OF THE INVENTION

It is an object of this invention to constantly cool and clean individual diamond inserts pressed into a diamond studded insert type rock bit.

More particularly, it is an object of this invention to provide coolant passages adjacent a multiplicity of individual diamond inserts to provide uniform fluid flow, cooling and cleaning action with minimal fluid pressure drop as the diamond drag bit is rotated in a borehole.

A method of cooling and cleaning a multiplicity of individual diamond insert cutter blanks inserted in the face of a diamond studded insert drag bit body consists of strategically locating and forming hydraulic passages in the face of the drag bit, the passages being formed by the bit body to assure uniform flow of fluid for cooling and cleaning of each of the diamond insert blanks. The hydraulic passages communicate with an interior hydraulic chamber formed in the drag bit body. Insert holes are strategically located and formed in the face of the bit, the insert holes being formed by the bit body to assure proper diamond insert cutting action to advance the drag bit in a borehole. Diamond insert cutter blanks are subsequently inserted in the previously formed insert holes in the diamond insert drag bit.

There are no intricately formed channels or grooves in the face of the diamond drag bit since the strategic location of the hydraulic passages in the bit assures uniform flow over the face of the drag bit. The drilling fluid or mud flows over and around the diamond insert blanks which extend between the face of the bit and the bottom of the borehole. The distance between the tip of the diamond insert and the face of the drag bit provides ample space for larger cuttings to be swept off the bottom of the hole and up the borehole for removal therefrom.

Where, for example, the hydraulic passages comprise a series of drilled holes, as opposed to nozzles, the drilled holes may be positioned adjacent each diamond insert blank or one drilled passage may be so strategically placed that it provides cleaning and cooling for at least a pair of adjacent diamond insert blanks.

The hydraulic passage may, for example, take the form of a slot. Each slot may cool one or several diamond insert blanks. The slots are generally aligned radially from the center of the drag bit. In addition, the slots may be variable in width. For example, where the slots are oriented radially in the face of the bit, the end of the slot nearest the center of the bit is wide and the opposite end of the slot nearest the peripheral edge of the drag bit is narrow. The variable width radial slot thus assures uniform distribution of flow across the face of the bit and an even pressure drop through the bit.

The constant diameter drilled hydraulic holes and the constant and variable width hydraulic slot passages provide uniform flow of drilling mud across the face of the bit. Nozzles associated with state of the art drag bits tend to accelerate fluid under and through the bit thereby creating erosion problems necessitating the use of erosion resistant materials and complicated bit body castings with flow channels formed therein.

With careful location of hydraulic passages in combination with individual diamond insert cutting elements inserted in the face of a drag bit and placed to maximize hole penetration, the erosion of the face of the bit is minimized, thus allowing the drag bit to be fabricated from alloy steel instead of a relatively expensive casting, such as, tungsten carbide.

Therefore, an advantage over the prior art is the combination of strategically located hydraulic passages in conjunction with individual diamond insert cutting blanks positioned in the face of a diamond studded insert drag bit to assure uniform flow of hydraulic fluid across the bit face and an even pressure drop through the bit while providing cooling and cleaning of each diamond insert.

Yet another advantage over the prior art is the use of steel drag bit bodies, as opposed to a very hard erosion resistant substance, to form the drag bit bodies with intricate hydraulic passages formed threrein.

The above noted objects and advantages of the present invention will be more fully understood upon a study of the following detailed description in conjunction with the detailed drawings.

FIG. 1 is a perspective view of a diamond studded drag bit body with individual diamond insert blanks inserted in the face of the bit with strategically positioned hydraulic passages in the face of the drag bit, FIG. 2 is an end view of the face of the bit as shown in FIG. 1, FIG. 3 is an end view of an alternative embodiment wherein a multiplicity of slots are formed in the face of the drag bit to provide cooling and cleaning of the individual diamond cutter insert blanks, and FIG. 4 is still another embodiment wherein the hydraulic passages are a series of variable width slots radially extending from the center of the drag bit to assure uniform flow of hydraulic fluid while providing cooling and cleaning for each of the diamond cutter inserts.

DESCRIPTION OF THE PREFERRED EMBODIMENTS AND BEST MODE FOR CARRYING OUT THE INVENTION

Figure 1:
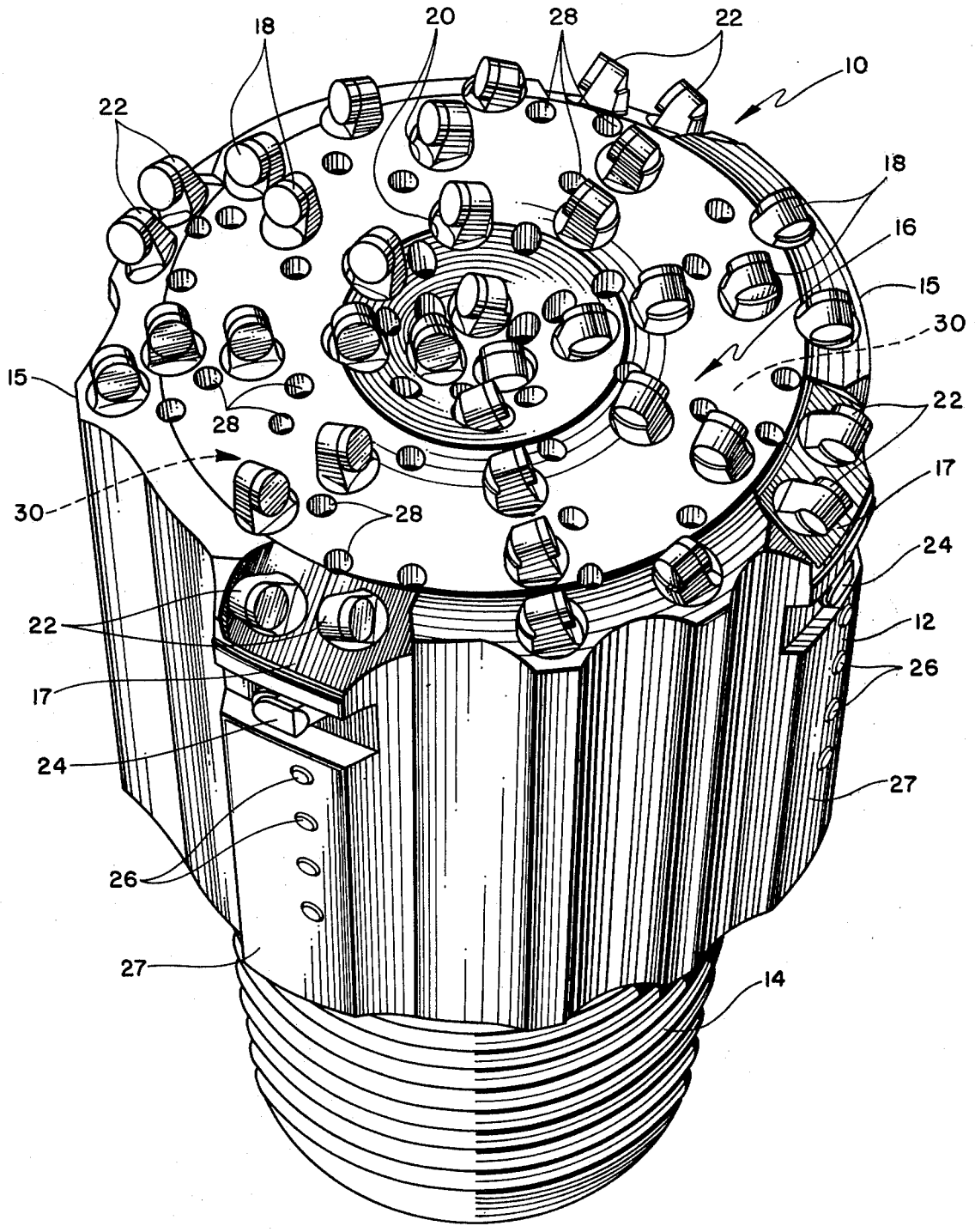

Turning now to the perspective view of FIG. 1, the diamond studded insert drag bit, generally designated as 10, consists of a drag bit body 12 having a pin end 14 and a face end 16. Face end 16 has a multiplicity of diamond insert cutter blanks 18 inserted in insert holes 20 formed by the bit body 12. The insert blanks 18, for example, are fabricated from a tungsten carbide substrate with a diamond layer sintered to a face of the substrate, the diamond layer being composed of a polycrystalline material. The synthetic polycrystalline diamond layer is manufactured by the Specialty Material Department of General Electric Company of Worthington, Ohio. The foregoing drill cutter blank goes by the trademark name of Stratapax drill blanks.

The diamond drag bit, since it is designed to rotate in the clockwise direction, has placed within the face 16 of the bit body 12 a multiplicity of hydraulic passage holes 28. Each hydraulic passage is strategically located in front of the inserts to pass fluid over and around the diamond cutting face of each of the individual Stratapax blanks 18 to cool and clean the inserts as the bit works in the borehole. Each of the hydraulic passages 28 communicates with a chamber 30 formed within the bit body 12 (not shown). The peripheral edge 15 of bit 12 defines four milled surfaces 17 and are positioned at 90° intervals around the gage of the bit. The gage row inserts 22 are in the milled surface 17. Each gage row surface 17 is machined at an angle to face 16. When the insert holes 20 are drilled 90° to the angled surface 17, the inserted gage row cutters 22 are therefore angled radially outwardly. The cutting end of each diamond insert 22 extends and defines the gage of the bit. Directly below each pair of gage row inserts 22 is defined four integral stabilizer bosses 27 formed in bit body 12. Each boss is aligned axially with the center line of the drag bit. Special diamond insert gage trimmers 24 ream the borehole as the bit is advanced in the hole. A series of axially aligned tungsten carbide flush-type inserts are positioned below the gage trimmers in each integral stabilizer 27 of bit body 12. The inserts 26, of course, are designed to prevent wear of the stabilizer bosses 27.

Since there are a relatively large number of hydraulic passage holes formed in the face 16 of the rock bit 10, and since each of the hydraulic passages is relatively large to prevent clogging as the bit is lowered to the hole bottom, the resultant hydraulic horsepower available through the bit is relatively low. The fluid pressure drop through the passages or holes 28 and across the face 16 of the drag bit, for example, averages approximately 25 to 30 pounds per square inch in a $9\frac{7}{8}''$ diamond studded drag bit where the pump hydraulic flow rates run from 300 to 370 gallons per minute. The specific bit hydraulic horsepower for the above bit size, pressure drops and flow rates, averages from 0.187 hhp/in$^2$ to 0.21 hhp/in$^2$. A $9\frac{7}{8}''$ diamond studded insert drag bit tested in a laboratory with 10,000 pounds of force, rotating at 100 revolutions per minute with a torque of 2,000 foot-pounds and a flow rate of 370 gallons per minute, drilled at a penetration rate of 41 feet per hour in Sierra White granite. Most $9\frac{7}{8}''$ diamond bits drilling at 41 fph would require 425 gpm and a specific hydraulic horsepower of 4.0 hhp/in$^2$ but this bit, because of uniform fluid flow, needed only 370 gpm. Because of strategically located flow passages and uniform fluid flow at each cutter, the laboratory tested $9\frac{7}{8}''$ diameter diamond studded drag bit has drilled at high rates of penetration with less than normal fluid circulation rate and bit pressure drop.

Diamond drag bits of the type shown in FIG. 1 are utilized in conjunction with downhole positive displacement mud motors or turbines. These mud motors and turbines typically rotate from 350 to 1000 revolutions per minute. The diamond bit, of the present invention, is ideally suited to mud motors and turbines since these devices are designed to operate with a downstream pressure drop of not more than 500 pounds per square inch. The low bit fluid pressure drop associated with the present bit would not be detrimental to the bearing seal life and operation of the pump motor as described.

Conventional diamond studded insert drag bits, designed for conventional rotary speeds from 80 to 250 rpm, have a small clearance between the formation or rock on hole bottom and the bit face. This is necessary to cause high fluid velocities beneath the bit to remove cuttings and to cool the individual diamond cutters. Pressure energy from the circulation fluid is converted to kinetic or velocity energy below the bit. The high fluid velocity causes severe erosion of the bit body face, requiring the bit bodies to be made of cast carbide. Cast carbide bodies necessary for fluid erosion resistance are very costly to manufacture.

Some diamond studded insert drag bits have been designed with special configurations of flow passageways or fluid channels in the bit face. Placed within these fluid passageways or channels are individual flow nozzles to convert pressure energy into velocity energy. These bits are also very expensive to manufacture.

Most conventionally designed natural diamond bits and synthetic diamond studded insert drag bits are designed to provide a bit hydraulic horsepower per one square inch of hole bottom of 1.0 to 4.5 hhp/in$^2$. This range of specific hydraulic horsepower is believed necessary to provide the cross-flow velocities under the bit to obtain adequate hole cleaning and diamond cutter cooling. A study of the fluid velocities under these bits reveals that there is a radical flow velocity caused by the fluid flowing from the center of the bit outward to the periphery and a rotational velocity imparted to the fluid from bit rotation. The resultant fluid velocity is comprised of the components of the radial flow velocity and the rotational fluid velocity. The radial flow velocity is dependent on the pump volume and is relatively fixed or limited by pump design and optimum circulation rates for the hole size. The most important velocity component is the rotational velocity. Bits run under Dyna-Drills (a pump motor manufactured by a Division of Smith International), or other mud motors and turbines, are rotated faster than bits rotated by conventional rotary tables. Consequently, the rotational fluid velocity and the resultant fluid velocity is of sufficient magnitude to clean the hole bottom and remove cuttings if each cutter is continually cleaned and cooled. The Dyna-Drills, mud motors, or turbines rotate bits from 300 to 1000 revolutions per minute.

Figure 2:
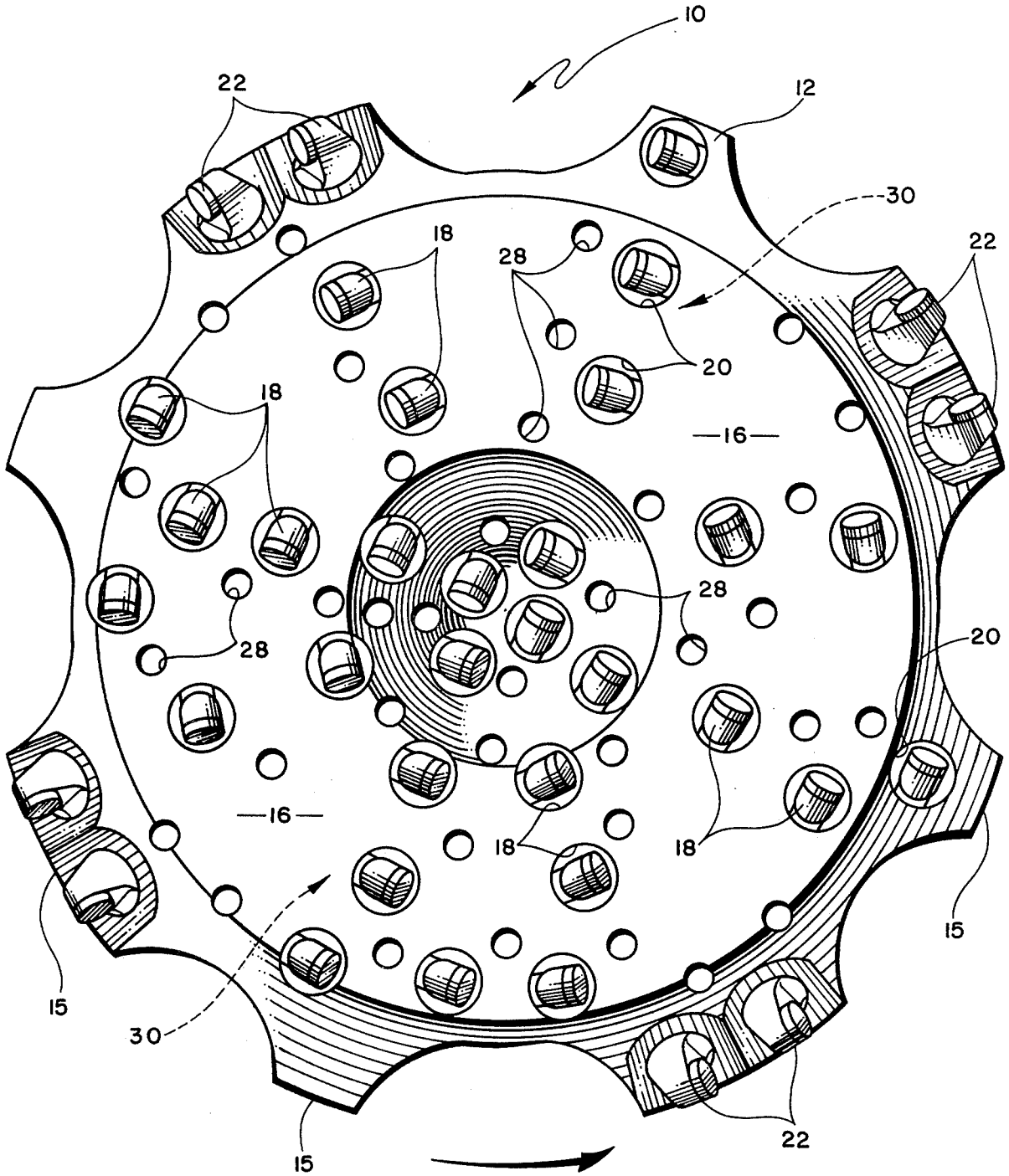
Figure 3:
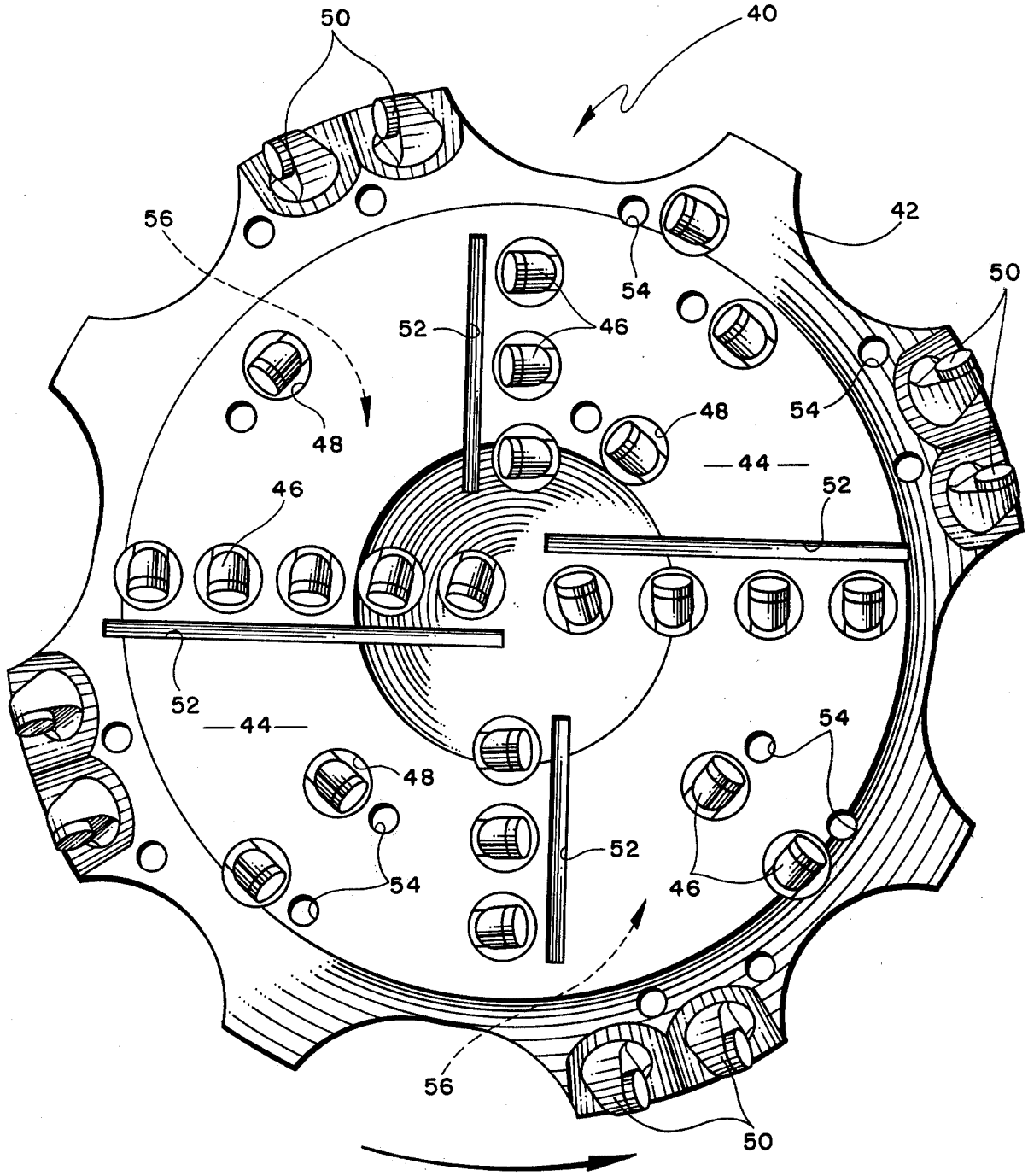

The bits described by this invention are designed with either individual fluid passages (holes) for each one or two diamond cutters as in FIG. 1 and FIG. 2 or they are designed with a combination of fluid flow slots and fluid passages as in FIG. 3.

Referring to FIG. 2, the strategic location of each of the constant diameter hydraulic passages 28 is clearly evident. As the rock bit is rotated in a clockwise direction, the fluid exiting the face 16 of the bit flows radially outwardly, over and around each insert 18. The gage row inserts 22 are illustrated with their cutting faces extending radially outwardly to the gage of the bit to maintain the proper gage of the borehole. An even distribution of fluid obviates the necessity of waterway channels positioned within the face of the drag bit. In addition, since there is a small pressure drop across the face of the present bit, there is no tendency to erode the face 16 of the bit body 12.

Turning to FIG. 3, the diamond drag bit illustrated is an alternative embodiment wherein the hydraulic passages consist of a series of radially extending constant width slots 52. Each of the slots 52 serve to provide hydraulic fluid to each of the diamond face inserts 46. The drag bit of FIG. 3 rotates in a clockwise direction, therefore the slots adjacent the face of each of the inserts 46 are positioned upstream of these inserts thus providing hydraulic fluid over and around each of the inserts 46. It would be impractical to provide radially extending slots for each of the diamond face inserts 46 where there are only one or two inserts, therefore, a constant diameter hydraulic passage 54 is positioned adjacent the face of each of the inserts 46 in the same manner as illustrated and described with reference to FIGS. 1 and 2. Each of the slots 52 and the hydraulic passages 54 communicate with a hydraulic chamber formed within the body 42 of the rock bit 40 (not shown). As in FIGS. 1 and 2, the alternative diamond bit 40 has four pairs of gage inserts 50 radially extending from the peripheral edge 51 of the bit body 42 to maintain the diameter of the borehole. The face 44 of the alternative rock bit 40 is a relatively flat surface not unlike FIGS. 1 and 2 and the body 42 of the diamond drag bit is fabricated from steel as opposed to being cast from an exotic erosion resistant material.

Figure 4:
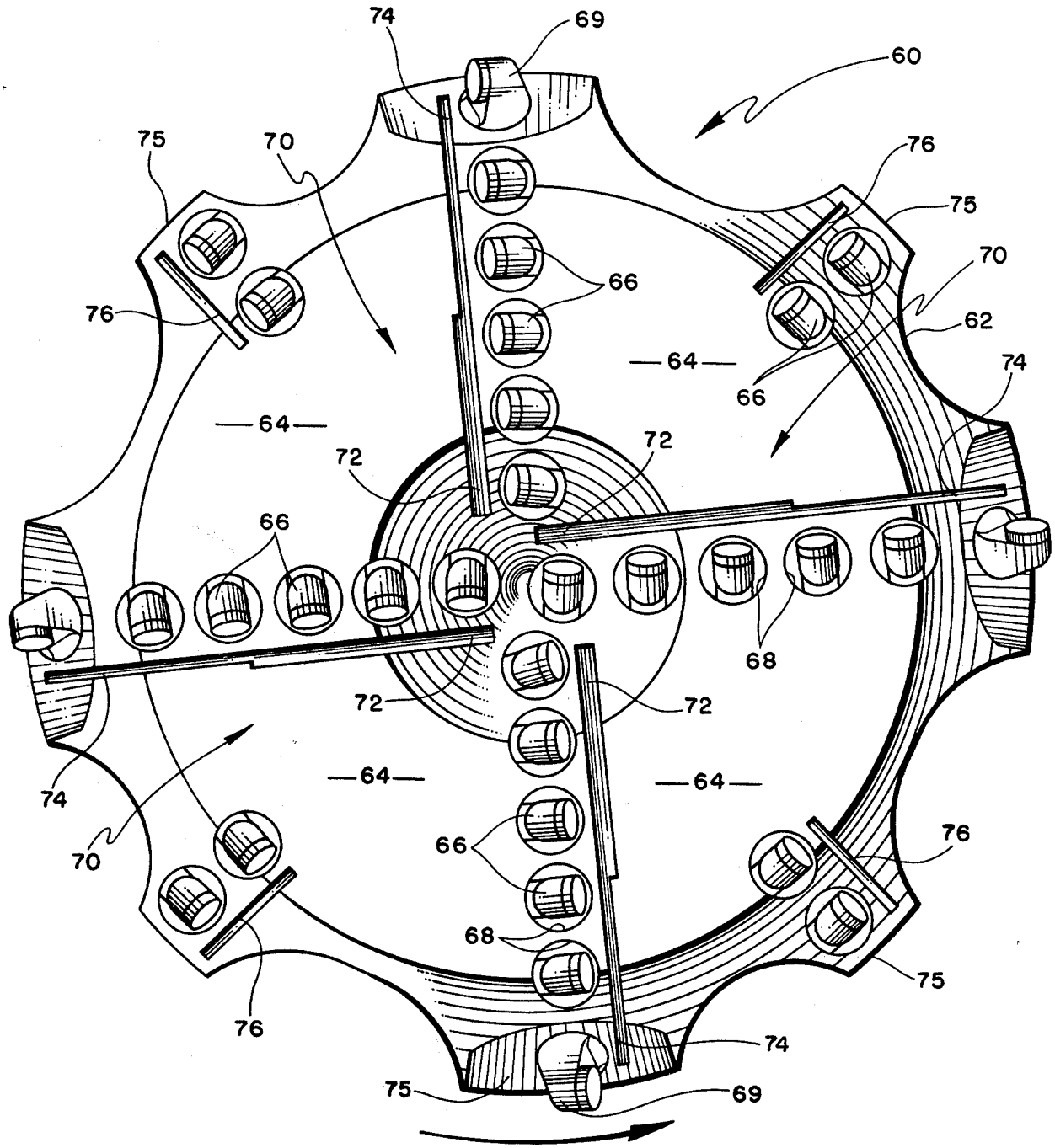

FIG. 4 is still another alternative embodiment wherein the diamond drag bit, generally designated as 60, is comprised of bit body 62 which forms a face end 64. The hydraulic passages 70 for this drag bit are comprised of radially extending variable width slots having an inboard end 72 wider in cross-section than an outboard end 74. End 74 terminates adjacent peripheral edge 75 of the bit body 62. The radially extending slots 70 are positioned upstream of the diamond faces of each of the diamond inserts 66 so that the fluid passes over and around each of the radially aligned inserts 66 in a bit rotating in a clockwise direction. The slots are wider near the center of the bit so that more flow can emanate from the center and sweep across the hole bottom. If the slots were wider at the periphery of the bit too much drilling fluid would flow directly to the hole annulus without crossing the hole bottom.

The fluid passages (holes), slots and combinations of passages (holes) and slots shown in FIGS. 1 through 4 are so sized and designed that only 25 to 30 psi pressure drop results from the fluid flow through the passages and/or slots.

Since Dyna-Drills and other positive displacement mud motors will not tolerate more than 50 to 500 psi downstream bit pressure drop, this bit is an ideal design for operation with such tools. The bit can be fabricated with conventional alloy steels which result in a less expensive manufacturing cost. The conventional alloy steel will not erode because the radial flow velocities under the bit are not as great as with other designs.

It will of course be realized that various modifications can be made in the design and operation of the present invention without departing from the spirit thereof. Thus, while the principal preferred construction and mode of operation have been explained in what is now considered to represent its best embodiment has been illustrated and described, it should be understood that within the scope of the appended claims the invention may be practiced otherwise than as specifically illustrated and described.

I claim:

1. A diamond studded insert drag bit apparatus comprising:

a substantially cylindrical drag bit body having a relatively flat first face end and a second pin end;

a multiplicity of individual diamond cutter blanks inserted in holes formed in said first face end of said drag bit body, said cutter blanks being strategically positioned in said face to assure maximum borehole penetration; and a plurality of hydraulic passages formed in said first face end, said passages are a plurality of variable width slots extending radially outwardly from a center of said first face end, said variable width slots being relatively wide nearest said center of said first face end and relatively narrow nearest a peripheral edge of said first face end of said drag bit body, said variable width slots thus distribute drilling mud uniformly across said face of said diamond studded drag bit, said drilling mud then simultaneously sweeps across the entire hole bottom thereby removing cuttings from the bottom of said borehole.

* * * * *